US008900048B2

(12) United States Patent
Pau

(10) Patent No.: US 8,900,048 B2
(45) Date of Patent: Dec. 2, 2014

(54) GAMING APPARATUS AND METHOD HAVING A GAME WITH A VARIABLE REEL FEATURE GAME

(75) Inventor: Edgar Pau, Carlton NSW (AU)

(73) Assignee: Aristocrat Technologies Australia Pty Ltd (AU)

( * ) Notice: Subject to any disclaimer, the term of this patent is extended or adjusted under 35 U.S.C. 154(b) by 1446 days.

(21) Appl. No.: 11/939,417

(22) Filed: Nov. 13, 2007

(65) Prior Publication Data

US 2008/0132321 A1 Jun. 5, 2008

(30) Foreign Application Priority Data

Nov. 13, 2006 (AU) ..... 2006906317

(51) Int. Cl.
*G07F 17/32* (2006.01)

(52) U.S. Cl.
CPC ..... *G07F 17/32* (2013.01)
USPC ..... 463/20

(58) Field of Classification Search
CPC ..... G07F 17/3244
USPC ..... 463/16–22
See application file for complete search history.

(56) References Cited

U.S. PATENT DOCUMENTS

| | | | | |
|---|---|---|---|---|
| 2006/0068883 | A1* | 3/2006 | Randall et al. | 463/20 |
| 2006/0189378 | A1* | 8/2006 | Aoki | 463/20 |
| 2007/0072665 | A1* | 3/2007 | Muir | 463/12 |

* cited by examiner

*Primary Examiner* — Paul A D'Agostino
(74) *Attorney, Agent, or Firm* — McAndrews, Held & Malloy, Ltd.

(57) ABSTRACT

Embodiments provide a method of gaming comprising wherein a wager for a play of a game is received from a player and a set of symbols for playing the game is determined based on the wager. The set of symbols includes, based on the wager, a number of specified symbols that can contribute to one or more specified winning game outcomes. Symbols selected from the set are displayed and an award made to the player if the displayed one or more symbols correspond to one or more of the specified winning game outcomes.

23 Claims, 4 Drawing Sheets

600

602

| | | | | |
|---|---|---|---|---|
| FROG | FROG | WILD | FROG | FROG |
| ELEPHANT | FROG | DOG | DOG | ELEPHANT |
| DOG | DOG | WILD | FROG | ELEPHANT |

GAMING APPARATUS AND METHOD HAVING A GAME WITH A VARIABLE REEL FEATURE GAME

CROSS-REFERENCE TO RELATED APPLICATIONS

The present application relates to, and claims priority from, Australian Patent Application No. 2006906317, filed on Nov. 13, 2006, entitled "GAMING APPARATUS AND METHOD HAVING A GAME WITH A VARIABLE REEL FEATURE GAME," which is herein incorporated by reference in its entirety.

FIELD OF THE INVENTION

The present invention relates to gaming apparatus and methods of gaming.

BACKGROUND OF THE INVENTION

With the increase of gambling at gaming venues has come increased competition between gaming venues to obtain a larger share of the total gambling spend. Gaming venue operators have therefore continuously looked for new variations and types of games in order to attract both new and return customers to their venues.

In response to this need, suppliers of gaming devices and systems have attempted to provide the sought-after variety, while still developing games that comply with the relevant regulations in the jurisdiction of the gaming venue operator. Suppliers of gaming devices are faced with restrictions on the types of games and gaming apparatus that are allowable, both in terms of the prevailing regulations and in terms of providing a return on investment to the gaming venue operators.

SUMMARY OF THE INVENTION

According to one aspect of the present invention there is provided a method of gaming comprising the steps of:

(a) receiving a wager for a play of a game from a player;

(b) determining a set of symbols for playing the game wherein the set of symbols includes, based on the wager, a number of specified symbols that can contribute to one or more specified winning game outcomes;

(c) displaying symbols selected from the set; and (d) making an award to the player if the displayed one or more symbols correspond to one or more of the specified winning game outcomes.

In an embodiment determining the set of symbols for playing the game comprises:

(a) determining a number of specified symbols for the set based on the wager;

(b) determining whether a base set of symbols for the game includes the determined number of specified symbols; and (c) replacing one or more symbols from the base set of symbols with a specified symbol such that the set of symbols includes the determined number of specified symbols.

In an embodiment symbols from the base set are selected for replacement with specified symbols.

In an embodiment the probability of one or more of the specified winning game outcomes occurring is dependent on the number of specified symbols. For example, the number of specified symbols in the set of symbols for the game can be in direct relationship to the wager amount.

In an embodiment a specified symbol can contribute to more than one specified winning outcome in a different capacity in each outcome, such that the probability of more than one specified winning outcome occurring is increased in proportion to the wager amount. For example, in one embodiment the specified symbol can contribute in a different capacity by taking the place of a different symbol in each outcome.

In an embodiment the award made to the player in response to at least one of the specified winning outcomes has a value substantially independent of the wager. In one embodiment the award is a prize which has a fixed value. In another embodiment the award is a progressive jackpot. In another embodiment the award is a prize which cannot be multiplied.

In an embodiment each specified symbol replacing a symbol of the base set is selected from a set of special symbols comprising one or more different specified symbols.

In an embodiment each specified symbol is a special function symbol. In another embodiment each specified symbol is a wild symbol. In another embodiment each specified symbol is a multiplier symbol.

In an embodiment the method is executed on an electronic gaming apparatus that displays one or more symbols from a set of symbols and makes an award to the player if the displayed one or more symbols correspond to one or more of the specified winning game outcomes. For example, the electronic gaming apparatus may be a stand alone gaming machine or alternatively a networked gaming apparatus having a central gaming server and one or more player terminals.

According to another aspect of the present invention there is provided a game controller comprising:

(a) a set controller adapted to determine based on a wager received from a player a set of symbols for the play of a game wherein the set of symbols includes a number of specified symbols;

(b) an outcome generator adapted to generate a game outcome by selecting symbols from the set of symbols and determine a game outcome based one or more specified winning combinations of symbols occurring in the selected symbols, wherein the specified symbols can contribute to one or more of the specified winning combinations; and (c) a prize awarder adapted to make an award to the player based on the respective game outcome.

According to another aspect of the present invention there is provided gaming system comprising:

(a) a credit input mechanism adapted to receive a wager for a play of a game from a player and provide wager amount data to a game controller;

(b) a game controller including:

(i) a set controller adapted to determine based on a received wager amount a set of symbols for the play of a game wherein the set of symbols includes a number of specified symbols;

(ii) an outcome generator adapted to generate a game outcome by selecting symbols from the set of symbols and determine a game outcome based one or more specified winning combinations of symbols occurring in the selected symbols, wherein the specified symbols can contribute to one or more of the specified winning combinations; and (iii) a prize awarder adapted to make an award to the player based on the respective game outcome; and (c) a display unit adapted to display the one or more selected symbols and any award made.

In an embodiment the set controller is further adapted to determine, based on the wager, a number of specified symbols to be included in the set of symbols for play of the game, and where a base set of symbols does not include the determined number of specified symbols, replace one or more symbols from the base set of symbols with specified symbols such that the set for play of the game includes the determined number of specified symbols. The set controller can be further adapted to select symbols for replacement with specified symbols from the base set of symbols.

In an embodiment the game is a spinning reel game and the set of symbols comprises symbols on one or more spinning reels. In an embodiment the spinning reels have respective fixed lengths such that the number of symbols on the reel does not change. In one embodiment the specified symbols are provided on only one reel. For example, the specified symbols may be provided on a centre reel of a plurality of reels.

According to another aspect there is provided a computer program comprising computer readable instructions which implement the gaming method as described above.

According to another aspect there is provided a computer readable medium comprising the computer program as described.

According to another aspect there is provided a data signal comprising the computer program as described.

BRIEF DESCRIPTION OF THE DRAWINGS

Embodiments of the invention are described below with reference to the Figures, in which.

DESCRIPTION OF CERTAIN EMBODIMENTS OF THE INVENTION

The arrangements described herein relate to a game in which a number of symbols are replaced with specified symbols in order to vary the probability of a winning outcome occurring in the game.

Operating Environment

Figure 1:
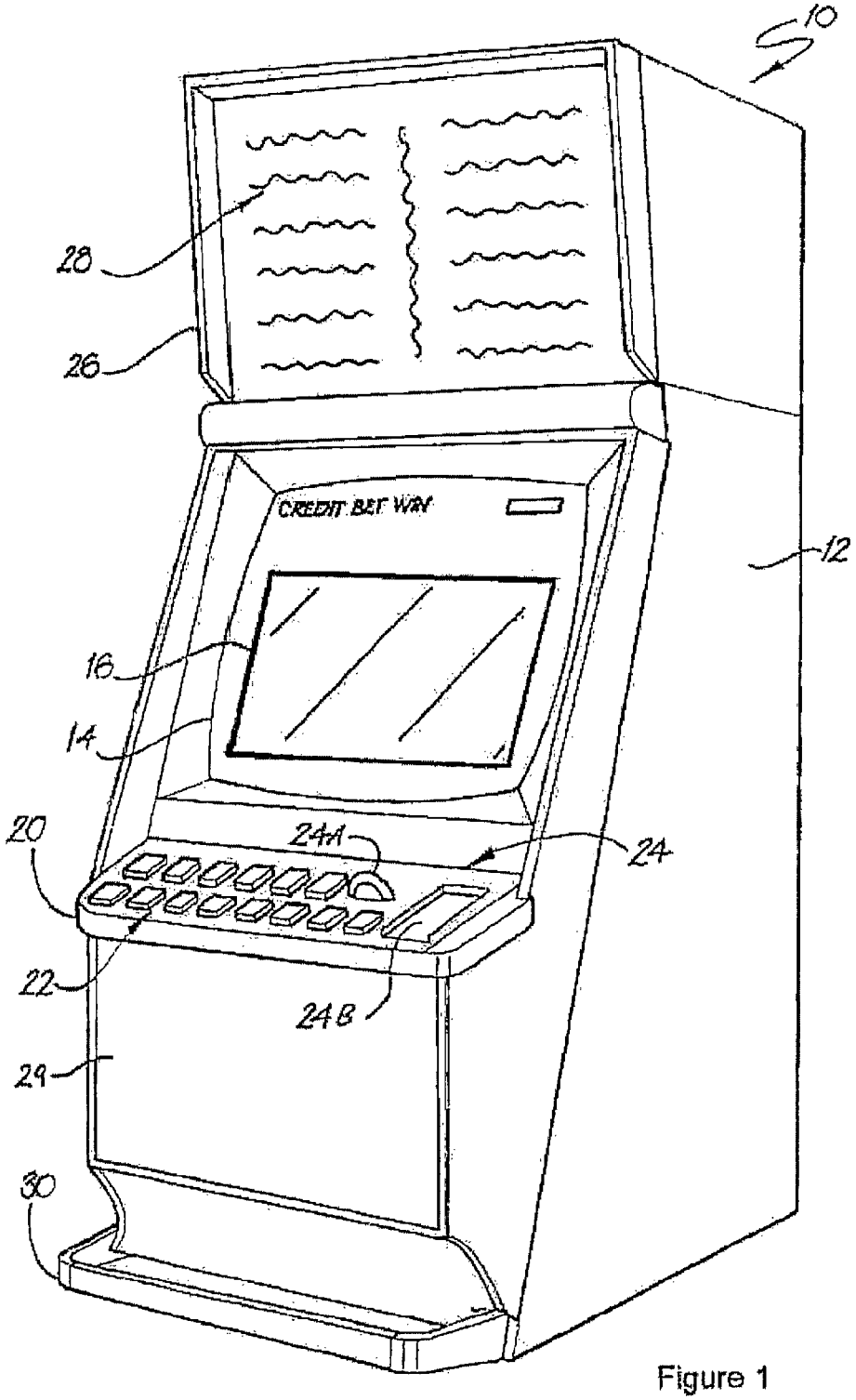
FIG. 1 shows schematically a view of a gaming machine suitable for implementing certain embodiments of the present invention.

In FIG. 1 of the accompanying drawings, one example of a gaming machine suitable for implementing certain embodiments of the present invention is generally referenced by arrow 10.

The gaming machine 10 includes a console 12 having a display 14 on which is displayed representations of a game 16 that can be played by a player. A mid-trim 20 of the gaming machine 10 houses a bank of buttons 22 for enabling a player to play the game 16. The mid-trim 20 also houses a credit input mechanism 24 including a coin input chute 24A and a bill collector 24B. A top box 26 may carry artwork 28, including for example, pay tables and details of bonus awards and other information or images relating to the game. Further artwork and/or information may be provided on the front panel 29 of the console 12. A coin tray 30 is mounted beneath the console 12 for cash payouts from the gaming machine 10.

The display 14 shown in FIG. 1 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or a different type of display.

Figure 2:
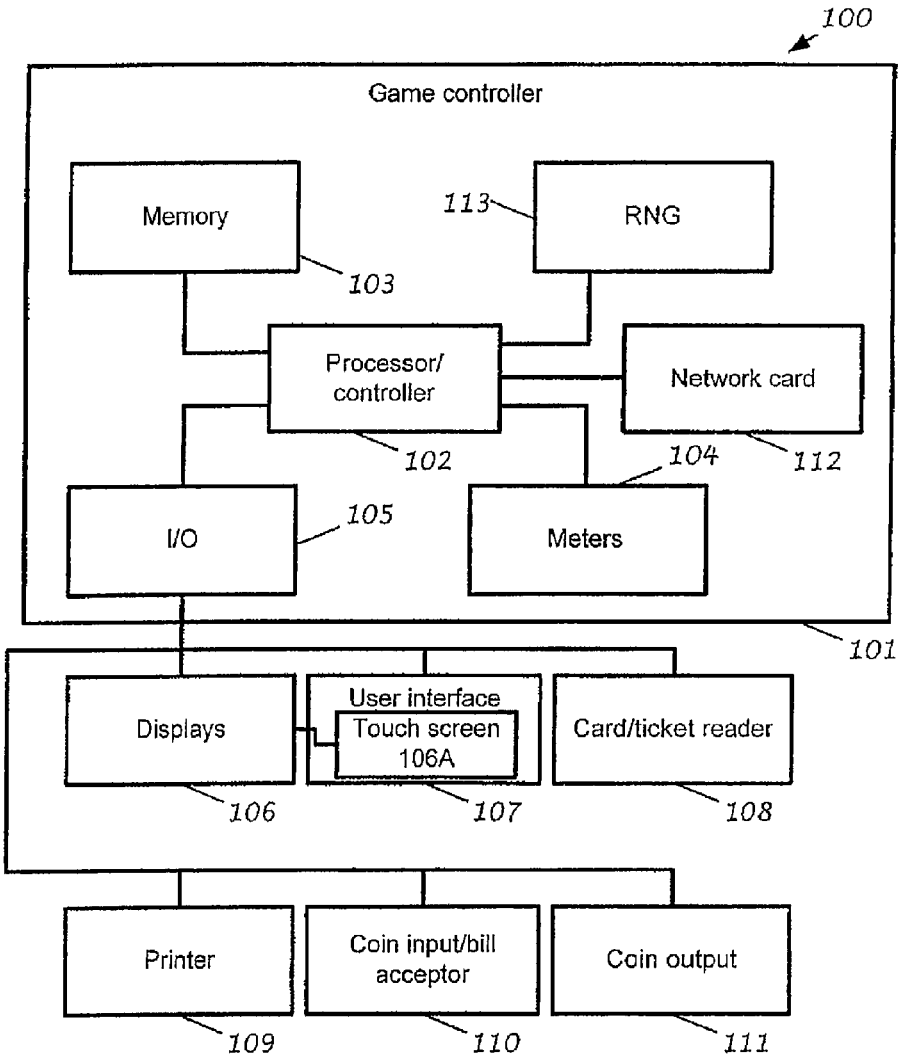
FIG. 2 shows a block diagram of gaming apparatus suitable for implementing certain embodiments of the present invention.

FIG. 2 shows a block diagram of a gaming apparatus, generally referenced by arrow 100, suitable for implementing certain embodiments of the present invention. The gaming apparatus 100 may, for example, operate as a standalone gaming machine of the type shown in FIG. 1. However, the gaming apparatus 100 may alternatively operate as a networked gaming machine, communicating with other network devices, such as one or more servers or other gaming machines. The gaming apparatus 100 may also have distributed hardware and software components that communicate with each other directly or through a network. Accordingly, different reference numerals have been used in FIG. 2 and FIG. 1 for components that may be equivalent.

The gaming apparatus 100 includes a game controller 101, which in the illustrated example includes a microprocessor, microcontroller, programmable logic device or other computational device 102. Instructions and data to control operation of the computational device 102 are stored in a memory 103, which is in data communication with the computational device 102. Typically, the gaming apparatus 100 will include both volatile and non-volatile memory and more than one of each type of memory, with such memories being collectively represented by the memory 103. The instructions to cause the game controller 101 to implement certain embodiments of the present invention are stored in the memory 103.

The gaming apparatus may include hardware meters 104 for the purposes of regulatory compliance and also include an input/output (I/O) interface 105 for communicating with the peripheral devices of the gaming apparatus 100. The input/output interface 105 and/or the peripheral devices may be intelligent devices with their own memory for instructions and data.

In the example shown in FIG. 2, the peripheral devices that communicate with the controller are one or more displays 106, user interfaces 107, a card and/or ticket reader 108, a printer 109, a bill acceptor and/or coin input mechanism 110 and a coin output mechanism 111. One or more of the displays 106 may include a touch screen 106A, forming part of the user interface 107. Additional devices may be included as part of the gaming apparatus 100, or devices omitted as required for the specific implementation.

In addition, the gaming apparatus 100 may include a communications interface, for example a network card 112. The network card, may for example, send status information, accounting information or other information to a central controller, server or database and receive data or commands from a the central controller, server or database. The game controller 101 may also include a random number generator 113, which generates a series of random numbers that determine the outcome of a series of random game events played as part of a game on the gaming apparatus 100. As explained in more detail in relation to FIG. 4, the computational device 102 may include two or more controllers or processors, which may be local or remote from each other and the displays 106.

Figure 3:
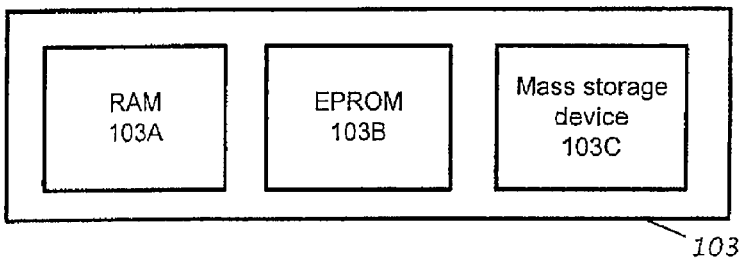
FIG. 3 shows a block diagram of components of the memory of the gaming apparatus represented in FIG. 2.

FIG. 3 shows an exemplary block diagram of the main components of the memory 103. The RAM 103A typically temporarily holds program files for execution by the computational controller 102 and related data. The EPROM 103B may be a boot ROM device and/or may contain some system or game related code. The mass storage device 103C is typically used to store game programs, the integrity of which may be verified and/or authenticated by the computational device 102 using protected code from the EPROM 103B or elsewhere.

Figure 4:
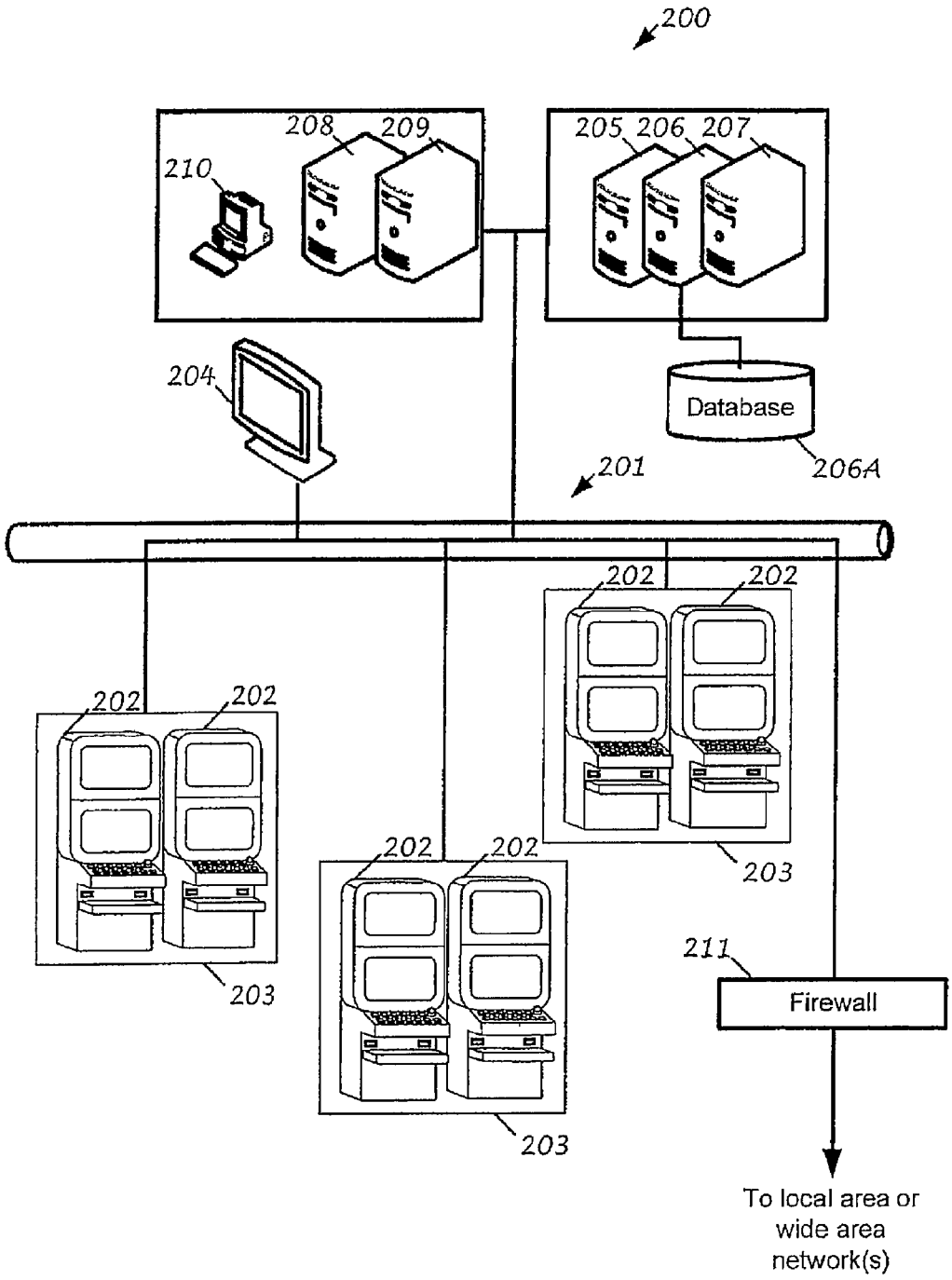
FIG. 4 shows schematically a network gaming system suitable for implementing certain embodiments of the present invention.

FIG. 4 shows a gaming system 200. The gaming system 200 includes a network 201, which for example may be an Ethernet network. Gaming devices 202, shown arranged in three banks 203 of two gaming devices 202 in FIG. 4, are connected to the network 201. The gaming devices 202 may be gaming machines 10, as shown in FIG. 1, or form part or all of another gaming apparatus 100. Single gaming device 202 and banks 203 containing three or more gaming devices 202 may also be connected to the network 201.

One or more displays 204 may also be connected to the network 201. The displays 204 may, for example, be associated with a bank 203 of gaming devices. The displays 204 may be used to display representations associated with game play on the gaming devices 202, and/or used to display other representations, for example promotional or informational material.

Servers may also be connected to the network 201. For example, a game server 205 may generate game outcomes for games played on the gaming devices 202, a database management server 206 may manage the storage of game programs and associated data for downloading or access by the gaming devices 202 in a database 206A, and a jackpot server 207 may control one or more jackpots associated with the gaming devices 202.

Further servers may be provided to assist in the administration of the gaming system 200, including for example a gaming floor management server 208, and a licensing server 209 to monitor the use of licenses to particular games. An administrator terminal 201 is provided to allow an administrator to run the network 201 and the devices connected to the network.

The gaming system 200 may communicate through a firewall 211 with other gaming systems, other local networks, for example a corporate network, and/or a wide area network such as the internet.

Fixed Prize Games

In some types of game played in the operating environment described above, a prize may be offered to a player that is independent of the amount wagered by the player. For example, a feature game may be offered in which the prize is a car. In this example the prize has a fixed value that clearly does not vary with the player's bet.

Another example of a prize that is substantially independent of the amount bet is a progressive prize that accumulates until won by a player. In this case the quantum of the prize may vary with time. However, a winning player is awarded the prize regardless of the amount he or she has wagered. The value of the jackpot generally increases for every game played, and thus the prize may not be entirely independent of the amount wagered. Multiple machines may be linked together to form a large progressive jackpot. Accordingly the percentage change in the jackpot due to any individual wager may be very small.

For convenience, the present specification uses the term 'fixed prize' to refer to a prize having a quantum that cannot be multiplied dependent on the amount wagered by a player.

Description of Method

Described herein is a game having a fixed prize, wherein the probability of a player winning the fixed prize is varied dependent on an amount wagered by the player.

In one embodiment the described method is used in a spinning reel game. However, the method may also be used in other games, for example keno, bingo and poker. In these games, symbols are displayed dependent on a random input, for example from random number generator 113. A player becomes entitled to a prize when a specified combination of symbols is displayed.

In an embodiment the probability of a specified combination of symbols occurring is altered as a function of to the number of credits wagered per game. For example in the spinning reel game, the probability is altered by adding specified symbols to the reels.

In a spinning reel game a number of spinning reels are displayed on a gaming apparatus. Traditionally physical reels were used, but increasingly the spinning reels are graphic objects defined in software and rendered to displays 106. Each of the reels has a defined strip length that determines the number of symbols that are present on the reel. For example, a reel may have a strip length of thirty symbols.

In a game play, the reels are spun and come to rest at a randomly selected position. Where the reels are defined in the software, the reels are not physically spun, but graphic objects are animated to give the appearance of spinning reels. The displays 106 show a predefined number of symbols from each reel. In one configuration there are five reels and three symbols are displayed from each reel. Thus, after a game play, a 5×3 array of symbols is displayed.

The player may bet credits on some or all of a number of defined 'lines' traversing the displayed array of symbols. A line may be a row of the array. Other lines may be defined such as a line consisting of symbols from alternate rows, e.g. [(1,1) (2,2) (1,3) (2,4) (1,5)] where the first number of each pair defines a displayed row and the second number defines a reel. The player may select how many multiples k of credit units to wager on each pay line.

A prize is paid if a specified combination of symbols occurs on a line for which the player has placed a bet. The probability of a specified combination occurring is varied by adding specified symbols to one or more of the reels. When a specified symbol is added, the reel strip length does not change. Instead, a specified symbol replaces the symbol previously present on the reel.

As the player bets more credit units per line, controlling software running for example on computational device 102 changes one or more of the reel strips to increase the number of specified symbols on the reel. The number of symbols replaced on reel strips is a function of the number of credit units wagered per line. The specified symbols may be all the same symbol, such as a wild symbol, or a plurality of specified symbols, such as a wild symbol, a double pay symbol and a triple pay symbol.

In a software implementation, the spinning reels are defined by data structures that define the set of symbols on each reel and the position of the symbols on the reel. The controlling software changes the data in the data structure to replace symbols on the reels with specified symbols.

In an alternative mechanical embodiment, the symbols may be added by using one or more overlay reels which are transparent in positions where no symbol is to be replaced and bear the specified symbol in a position where the regular reel symbol is to be replaced. The overlay reel having the required number of replacement symbols is selected an overlaid on the regular reel such that it spins in concert with the regular reel. Thus the displayed outcome can show regular and overlay reel symbols.

Various types of symbols may be used as a specified symbol. The specified symbol may, for example be a wild symbol that stands in for a range of other symbols. Alternatively the specified symbol can be a double or multiplying symbol. In another embodiment the specified symbol can be a regular symbol which is included in the base set that can contribute to one or more predetermined prize winning symbol combinations.

There may be several specified symbols such as multiple, function and wild symbols. For example, a first wild symbol may substitute for a first picture on the reels and a second wild may substitute for a second picture. The quantity of both the first and second wilds may be increased on the reels dependent on the player's wager.

If the specified symbol acts as a wild symbol, the specified symbol may substitute for any other symbol specified in the rules of the game to form a winning combination. A wild symbol can also contribute to more than one winning symbol combination. Where symbol combinations appear on different lines, a single wild symbol may take on a different character in each winning combination. For example a wild may substitute for a dog in a horizontal line of three dogs for one combination and the same wild substitute for a cat in a diagonal line of three cats for another winning combination. Increasing the number of wild symbols on a reel enables the chance of a winning combination to vary in proportion to the bet. For example, if 1 credit buys 1 chance of winning the combination, then 10 credits may buy 10 chances of winning the same combination.

A wild symbol may be substituted for other symbols on one or more reels. The replaced symbols or replacement symbol positions may be predetermined or selected based on the game rules. Where the replacement symbol positions or symbols are selected, these may be selected when the wager is placed based on the output of a random number generator or game rules.

The rules of the game, including the function of the specified symbol, may be displayed on the gaming device, for example on displays 106. The displayed rules explain to the player that increasing the bet increases the occurrence of the specified symbols. The player is thus aware that the specified symbol contributes to a win.

Figures 5, 6:
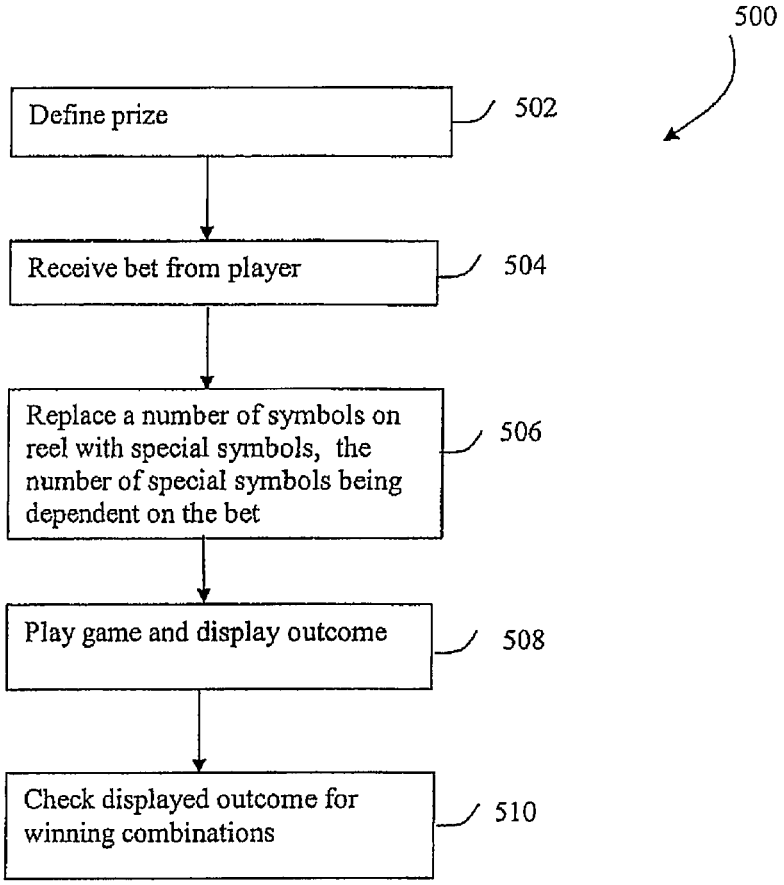
FIG. 5 is a flow diagram of a method of providing a game in which a number of specified symbols replace symbols on a spinning reel displayed on a gaming apparatus.
FIG. 6 shows an example of a winning outcome in the game of FIG. 5.

FIG. 5 illustrates a method 500 for providing the game on a gaming machine 10, gaming apparatus 100 or gaming system 200. The game may be a base game or a feature game offered in the course of a base game. An event in the base game may trigger a feature game, which may include one or more free games.

In an initial step 502 the fixed prize is defined. The fixed prize may, for example, be a car or a progressive prize that accumulates over time until the prize is won. The prize may be associated with a particular gaming device, or it may be associated with a gaming system 200. Information about a progressive prize may, for example, be displayed on display 204. More than one prize may be offered. For example, the game may involve three different jackpots each associated with a different combination of symbols, and the specified symbol may contribute to all combinations by standing in for a different symbol in each combination.

In step 504 the player places a wager using, for example, the coin or bill acceptor 110. Then, in step 506 controlling software running, for example on computational device 102 replaces a number of symbols on one or more reels with specified symbols. The number of specified symbols added is dependent on the wager placed by the player. If the game is a free game offered as part of a feature game, the number of specified symbols may be added dependent on a wager placed by the player in the base game.

The number of symbols added may also be dependent on the number of specified symbols included in a base set of symbols. For example a base set may include one specified symbol and this may be the number of specified symbols to include in the set for the game play where a minimum wager is placed. If more than the minimum wager is placed then the appropriate number of specified symbols, determined based on the wager, will be added to the base set by replacing symbols in the set to provide the set for game play including the appropriate number of specified symbols.

In step 508 the controlling software plays a game and determines an outcome that depends on one or more random events using, for example, random numbers from random number generator 113. The outcome of the game is represented as a group of graphic objects rendered, for example, to displays 106.

In step 510 the controlling software checks the game outcome for winning combinations of symbols. If a winning combination has occurred according to the rules of the game, a prize is awarded to the player. The winning combination may include one or more specified symbols.

The specified symbol may be a copy of a symbol included in a regular reel set. For example a regular reel set may include a single wild symbol and replacing symbols adds further wild symbols to the reel to increase the chances of a prize winning combination occurring.

EXAMPLE

In one example, the player plays a spinning reel game having 5 reels each revealing 3 symbols in the display window when the reels stop spinning. The player may bet on up to 20 lines and may choose to bet 1, 2, 3, 5 or 10 credits per line.

The game has three jackpot symbols, namely a frog, an elephant and a dog. In addition, the game has a wild symbol. If 4 frogs plus a wild symbol appear on a payline, a major jackpot is won. If 4 elephants plus a wild symbol appear on a payline, a minor jackpot is won. If 4 dogs plus a wild symbol appear on a payline, a mini jackpot is won. It should be appreciated therefore that a wild symbol may complete a combination of frogs, dogs or elephants depending on the neighbouring symbols on the payline.

If the player is only playing 1 credit per line, the centre reel includes only 1 wild symbol. If the player is playing 2 credits per line, the number of wild symbols on the centre reel increase to 2. If the player plays 3, 5 or 10 credits per line, the number of wild symbols on the centre reel increase to 3, 5 or 10 respectively. The strip length of the centre reel remains constant. The number of jackpot symbols (i.e. frog, elephant and dog) on reels 1, 2, 4 and 5 remains constant. The chance of spinning up one of the jackpot combinations thus increases in proportion to the credits bet per line.

FIG. 6 shows an example of a winning combination. The array of symbols 600 displayed when the five reels have come to a halt includes a winning combination on the first row 602. The combination of 4 FROGS and a WILD wins the player the major jackpot.

While the foregoing description has been provided by way of example of certain embodiments of the present invention as presently contemplated, which utilise gaming apparatus and machines, those skilled in the relevant arts will appreciate that the present invention also may have application to internet gaming and/or have application to gaming over a telecommunications network, where handsets are used to display game outcomes and receive player inputs. The described arrangements broadly relate to methods for varying the probability of winning a prize by replacing a number of symbols with specified symbols that contribute to one or more winning combinations.

Where in the foregoing description reference has been made to integers having known equivalents, then those equivalents are hereby incorporated herein as if individually set forth.

Those skilled in the relevant arts will appreciate that modifications and additions to the embodiments of the present invention may be made without departing from the scope of the present invention.

It will be understood that the invention disclosed and defined in this specification extends to all alternative combinations of two or more of the individual features mentioned or evident from the text or drawings. All of these different combinations constitute various alternative aspects of the invention.

It will also be understood that the term "comprises" (or its grammatical variants) as used in this specification is equivalent to the term "includes" and should not be taken as excluding the presence of other elements or features.

The invention claimed is:

1. A method of gaming on an automated gaming system having at least one gaming machine including a display having a plurality of regular mechanical reels and at least one mechanical overlay reel configured to overlie a corresponding one of the plurality of regular mechanical reels, the automated gaming system further having at least one processing unit configured to execute one or more method operations, the method comprising the steps of:

establishing a first set of symbols on the plurality of regular mechanical reels, wherein the first set of symbols corresponds to a first likelihood of a winning outcome of a game that is to be executed at the gaming machine;

establishing at least one replacement symbol on the at least one mechanical overlay reel, wherein a combination of the first set of symbols and the at least one replacement symbol provides a second set of symbols having a second likelihood of a winning outcome of the game, the second likelihood being greater than the first likelihood;

receiving a wager for a play of the game from a player at the gaming machine;

using the first set of symbols to play the game at the gaming machine if the wager is of a first value;

if the wager is of the first value, selecting a fixed number of symbols from the first set of symbols for determining an outcome of the game, wherein the outcome is displayed on the display;

if the wager is of a second, higher value, replacing at least one symbol of the first set of symbols on the corresponding one of the plurality of regular mechanical reels with the at least one replacement symbol of the at least one mechanical overlay reel by directing the at least one mechanical overlay reel to a position in which the at least one replacement symbol of the at least one mechanical overlay reel overlies the at least one symbol of the first set of symbols that is to be replaced; and using the second set of symbols to play the game by rotating the plurality of regular mechanical reels and the at least one mechanical overlay reel in concert, and displaying an outcome of the game on the display.

2. A method as claimed in claim 1 wherein the at least one symbol of the at least one mechanical overlay reel contributes to more than one winning outcome in a different capacity in each outcome, such that the probability of more than one specified winning outcome occurring is increased in proportion to the wager value.

3. A method as claimed in claim 2 wherein the at least one symbol of the at least one mechanical overlay reel contributes in a different capacity by taking the place of a different symbol in each outcome.

4. A method as claimed in claim 1 wherein an award made to the player in response to at least one winning outcome has a value independent of the wager value.

5. A method as claimed in claim 4 wherein the award is a prize which has a fixed value.

6. A method as claimed in claim 4 wherein the award is a progressive jackpot.

7. A method as claimed in claim 4 wherein the award is a prize which cannot be multiplied.

8. A method as claimed in claim 1 wherein the at least one symbol of the at least one mechanical overlay reel replacing a symbol of the first set of symbols is selected from a set of special symbols comprising one or more different specified symbols.

9. A method as claimed in claim 1 wherein the at least one symbol of the at least one mechanical overlay reel replacing a symbol of the first set of symbols is a special function symbol.

10. A method as claimed in claim 1 wherein the at least one symbol of the at least one mechanical overlay reel replacing a symbol of the first set of symbols is a wild symbol.

11. A game controller having one or more processing units configured to implement one or more sub-controllers of a gaming machine having a plurality of regular mechanical reels and a plurality of mechanical overlay reels configured to overlie respective ones of the regular mechanical reels, the game controller comprising:

a symbol set sub-controller adapted to determine, based on a value of a wager received from a player, a set of symbols for the play of a game, wherein the set of symbols includes a first set of symbols and a second set of symbols, wherein the second set of symbols contribute to a higher likelihood of a winning outcome than the first set of symbols;

an outcome generator sub-controller adapted to generate a game outcome by replacing one or more symbols from the first set of symbols with one or more symbols from the second set of symbols, wherein the outcome generator sub-controller selects a first number of symbols from the first set of symbols for replacement by a corresponding first number of the second set of symbols when a player wager is of a first value, and a second number of symbols from the first set of symbols for replacement by a corresponding second number of the second set of symbols when the player wager is of a second value greater than the first value, and to determine a game outcome based on one or more specified winning combinations of symbols occurring in the selected symbols;

a reel sub-controller configured to control spinning of the plurality of regular mechanical reels and the plurality of mechanical overlay reels by rotating the plurality of regular mechanical reels and the at least one mechanical overlay reel in concert, wherein replacement of the one or more symbols of the first set of symbols with one or more symbols from the second set of symbols comprises overlaying the one or more symbols of the first set of symbols on the plurality of regular mechanical reels with the one or more symbols of the at least one mechanical overlay reel; and a prize awarder sub-controller adapted to make an award to the player based on the respective game outcome.

12. A game controller as claimed in claim 11 wherein, if the player wager is of the second value, the symbol set sub-controller is further adapted to replace one or more symbols from the first set of symbols with symbols from the second set of symbols such that the set for play of the game includes a determined number of symbols from each of the first and second set of symbols.

13. A game controller as claimed in claim 12 wherein the number of symbols replaced from the second set of symbols is in direct relationship to the wager value.

14. A game controller as claimed in claim 12 wherein a symbol from the second set of symbols can contribute to more than one specified winning outcome in a different capacity in each outcome, such that the probability of more than one specified winning outcome occurring is increased in proportion to the wager value.

15. A game controller as claimed in claim 12 wherein an award made in response to at least one of the specified winning game outcomes has a value substantially independent of the wager value.

16. A game controller as claimed in claim 15 wherein the award is a prize having a fixed value.

17. A game controller as claimed in claim 15 wherein the award is a progressive jackpot.

18. A game controller as claimed in claim 15 wherein the award is a prize which cannot be multiplied as a result of game play.

19. A game controller as claimed in claim 12 wherein each symbol of the second set of symbols that replaces a symbol of the first set of symbols is selected from a set of special symbols.

20. A game controller as claimed in claim 11 wherein each symbol of the second set of symbols is a special function symbol.

21. A game controller as claimed in claim 11 wherein each specified symbol is a wild symbol.

22. A game controller as claimed in claim 11 wherein each symbol of the second set of symbols is a multiplier symbol.

23. A non-transitory computer readable medium including executable instructions that, when run on a gaming controller having a display, the display having a plurality of regular mechanical reels and at least one mechanical overlay reel configured to overlie a corresponding one of the plurality of regular mechanical reels, perform a method comprising:

establishing a first set of symbols on the plurality of regular mechanical reels, wherein the first set of symbols corresponds to a first likelihood of a winning outcome of a game executed with the gaming machine;

establishing at least one replacement symbol on the at least one mechanical overlay reel, wherein a combination of the first set of symbols and the at least one replacement symbol provides a second set of symbols having a second likelihood of a winning outcome of the game, the second likelihood being greater than the first likelihood;

receiving a wager for a play of the game from a player at the gaming machine;

using the first set of symbols to play the game if the wager is of a first value;

if the wager is of the first value, selecting a fixed number of symbols from the first set of symbols for determining an outcome of the game, wherein the outcome is displayed on the display;

if the wager is off a second, higher value, replacing at least one symbol of the first set of symbols on the corresponding one of the plurality of regular mechanical reels with the at least one replacement symbol of the at least one mechanical overlay real by directing the at least one mechanical overlay reel to a position in which the at least one replacement symbol of the at least one mechanical overlay reel overlies the at least one symbol of the first set of symbols that is to be replaced; and using the second set of symbols to play the game by rotating the plurality of regular mechanical reels and the at least one mechanical overlay reel in concert, and displaying an outcome of the game on the display.

* * * * *